US011053701B2

(12) United States Patent
Erlich et al.

(10) Patent No.: US 11,053,701 B2
(45) **Date of Patent: *Jul. 6, 2021**

(54) SUBMERSIBLE ELECTRIC-POWERED LEAF VACUUM CLEANER

(71) Applicant: Water Technology LLC, East Brunswick, NJ (US)

(72) Inventors: Guy Erlich, Monroe Township, NJ (US); James Kosmyna, Long Pond, PA (US); John A. Many, Surfside Beach, SC (US); Jonathan Elmaleh, Brooklyn, NY (US); Curtis Elliott, Washington, NJ (US)

(73) Assignee: Water Technology, LLC, East Brunswick, NJ (US)

( * ) Notice: Subject to any disclaimer, the term of this patent is extended or adjusted under 35 U.S.C. 154(b) by 263 days.

This patent is subject to a terminal disclaimer.

(21) Appl. No.: 16/149,775

(22) Filed: Oct. 2, 2018

(65) Prior Publication Data

US 2019/0032355 A1 Jan. 31, 2019

Related U.S. Application Data

(63) Continuation of application No. 14/075,615, filed on Nov. 8, 2013, now Pat. No. 10,094,130.

(51) Int. Cl.
*E04H 4/16* (2006.01)

(52) U.S. Cl.
CPC ..... *E04H 4/1636* (2013.01); *E04H 4/1618* (2013.01)

(58) Field of Classification Search
CPC ..... E04H 4/1636; E04H 4/1618
See application file for complete search history.

(56) References Cited

U.S. PATENT DOCUMENTS 3,008,159 A 11/1961 Del Vecchio
3,755,843 A 9/1973 Goertzen, III et al.
(Continued)

FOREIGN PATENT DOCUMENTS

GB 1590623 6/1981
WO 2014173937 A2 10/2014

OTHER PUBLICATIONS

European Patent Office—Notification pursuant to Rule 62a(1) EPC, dated Jul. 11, 2017 for EP Appl'n No. 14 860 828.4.
(Continued)

*Primary Examiner* — David Redding
(74) *Attorney, Agent, or Firm* — Abelman, Frayne & Schwab

(57) ABSTRACT

An electric-powered submersible pool cleaner includes a base, discharge conduit, and outwardly extending flange. The base includes an inlet port, and the discharge conduit extends upwardly from the base and circumscribes the inlet port and a portion of an electric-powered impeller to direct the flow of water and debris drawn through the inlet. The outwardly extending flange extends from an upper portion of the discharge conduit and secures a filter to filter debris and pass clean water back into the pool. The impeller includes one or more blades having leading and trailing edges and is set at a height such that the leading edges of the blades are positioned to extend into the discharge conduit below a lower portion of the outwardly extending flange and the trailing edges of the blades extend above the lower portion of the outwardly extending flange. A handle provides maneuverability of the cleaner.

27 Claims, 10 Drawing Sheets

(56) References Cited

U.S. PATENT DOCUMENTS

| | | | |
|---|---|---|---|
| 3,886,616 | A | 6/1975 | Hayes |
| 3,961,393 | A | 6/1976 | Pansini |
| 4,443,899 | A | 4/1984 | Johnson |
| 4,558,479 | A | 12/1985 | Greskovics et al. |
| 4,651,376 | A | 3/1987 | Ford |
| 4,801,376 | A | 1/1989 | Kulitz |
| 4,935,980 | A | 6/1990 | Leginus et al. |
| 4,962,559 | A | 10/1990 | Schuman |
| 5,111,129 | A | 5/1992 | Schuman |
| 5,135,647 | A | 8/1992 | Childers |
| 5,137,623 | A | 8/1992 | Wall et al. |
| 5,450,644 | A | 9/1995 | Berman |
| 5,554,277 | A | 9/1996 | Rief et al. |
| 5,569,371 | A | 10/1996 | Perling |
| 5,768,734 | A | 6/1998 | Dietrich |
| 5,842,243 | A | 12/1998 | Horvath et al. |
| 5,951,854 | A | 9/1999 | Goldberg et al. |
| 5,961,822 | A | 10/1999 | Polimeni, Jr. |
| 6,248,232 | B1 | 6/2001 | Stoner |
| 6,294,084 | B1 | 9/2001 | Henkin et al. |
| 6,942,790 | B1 | 9/2005 | Dolton |
| 8,281,441 | B1 | 10/2012 | Erlich et al. |
| 10,094,130 | B2 * | 10/2018 | Erlich ..... E04H 4/1618 |
| 2001/0004974 | A1 | 6/2001 | Ekenback et al. |
| 2001/0032809 | A1 | 10/2001 | Henkin et al. |
| 2001/0050093 | A1 | 12/2001 | Porat |
| 2002/0002750 | A1 | 1/2002 | Phillipson et al. |
| 2005/0247613 | A1 | 11/2005 | Bishop et al. |
| 2006/0048312 | A1 | 3/2006 | Horvath et al. |
| 2007/0094817 | A1 | 5/2007 | Stoltz et al. |
| 2008/0235887 | A1 | 10/2008 | Horvath et al. |
| 2009/0282627 | A1 | 11/2009 | Porat |
| 2012/0216837 | A1 | 8/2012 | Kovarik et al. |
| 2013/0061407 | A1 | 3/2013 | Ben-Dov et al. |

OTHER PUBLICATIONS

Canadian Intellectual Property Office—Office Action dated Jan. 29, 2018 for CA Appl'n. No. 2,932,147.

Canadian Intellectual Property Office—Office Action dated May 5, 2017 for CA Appl'n. No. 2,932,147.

* cited by examiner

FIG. 12
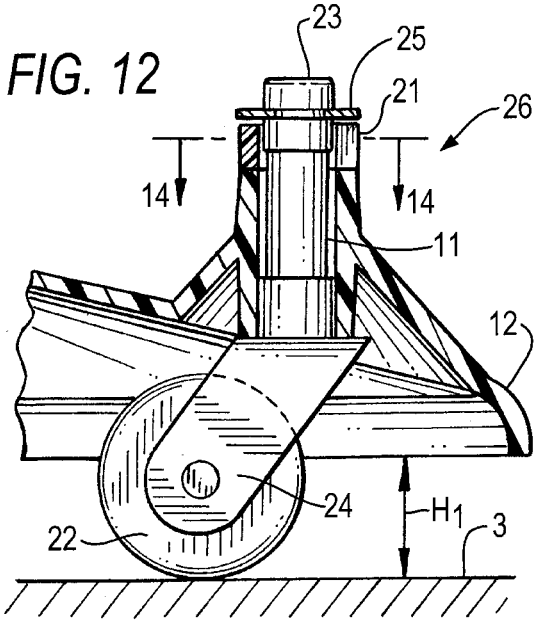
FIG. 13
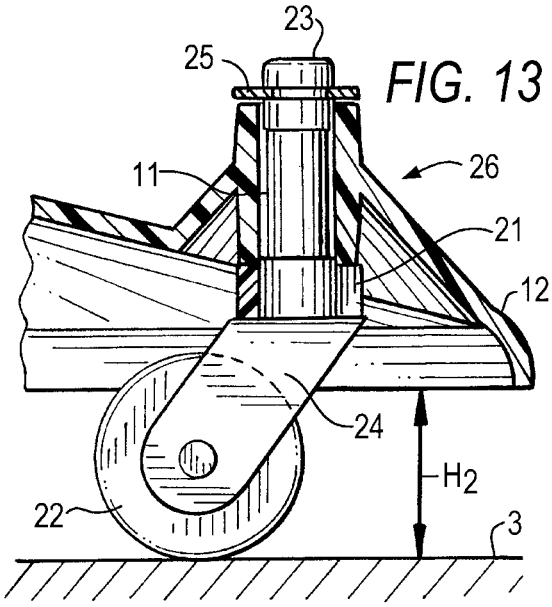
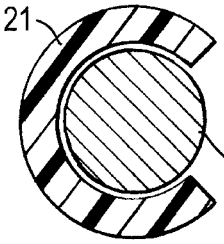
FIG. 14
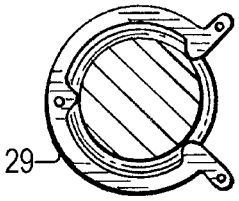
FIG. 17
FIG. 15
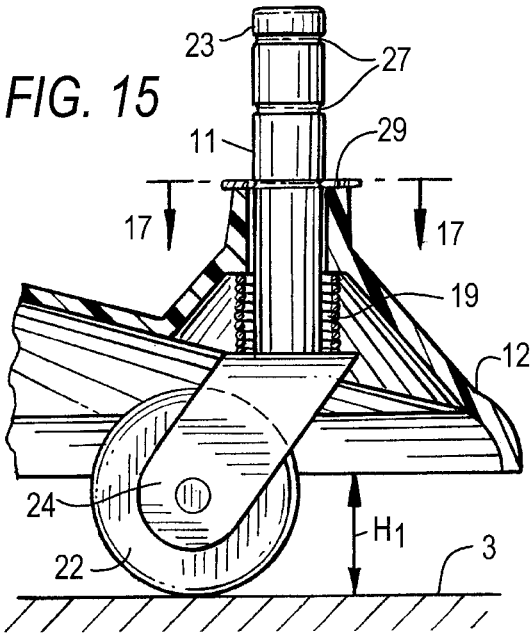
FIG. 16
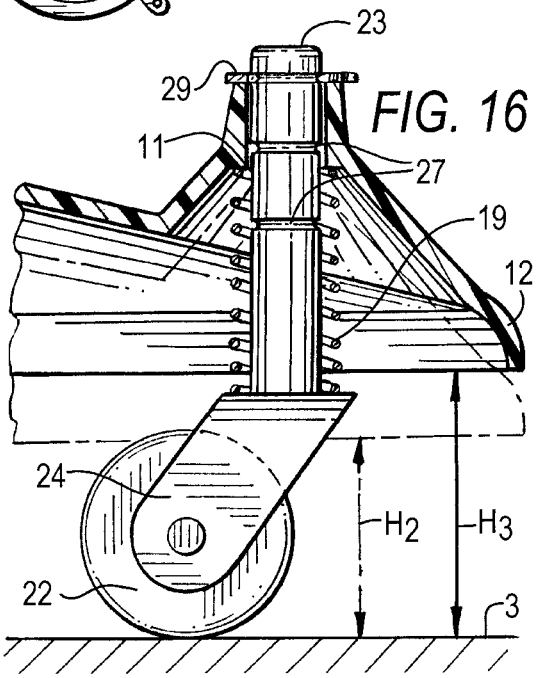

SUBMERSIBLE ELECTRIC-POWERED LEAF VACUUM CLEANER

CROSS-REFERENCE TO RELATED APPLICATION

This application is a continuation of U.S. Pat. No. 10,094,130, issued Oct. 9, 2018, the contents of which is incorporated by reference herein in its entirety.

FIELD OF THE INVENTION

The present invention relates to pool cleaning devices and more specifically to electric-powered pool cleaning devices.

BACKGROUND OF THE INVENTION

Owners of swimming pools must maintain their pool to keep the water clean to maintain sanitary conditions, help maximize their swimming enjoyment and also prevent deterioration of the pool equipment. Many types of pool cleaners are commercially available for residential and commercial use including automated robotic cleaners, self-propelled cleaners and manually operated pool cleaners. The manually operated cleaners are usually less expensive than the robotic or self-propelled cleaners because they are less complex and simpler to manufacture. The manually operated cleaners require that an individual guide the cleaner over the surface of the pool, typically with the assistance of an extension pole or handle assembly.

One type of hand-held, manually operated pool cleaner that is commercially available for residential use is based on expired U.S. Pat. No. 3,961,393 to Pansini. The '393 patent discloses a submersible leaf vacuum cleaner which includes a housing and a filter bag serving as a collector for pool debris. The housing is supported by wheels and includes an annular flange or skirt and an open-ended tubular member or conduit, the bottom of which serves as an inlet and the upper portion serving as a discharge outlet. The housing further includes a water discharge ring to which a water supply hose is attached for delivery of pressurized water from a remote service. The housing may also have a handle attached. The ring is provided with a plurality of equidistantly spaced water discharge orifices that are adapted to direct jets of water along like paths, which are projected above the open upper end of conduit. The projections of the jets are in a spiraled pattern.

More specifically, in order to draw water from the pool through the inlet, an external pressurized water source, such as from a conventional garden hose, is attached to the housing, and the water from the garden hose flows into the open-ended tubular member or conduit via a plurality of discharge orifices, thereby providing a plurality of high pressure water jets into the conduit. The water jets are directed upwardly towards the discharge opening of the conduit. Because of the restricted flow of the water through the narrow discharge orifice of the jets, a Venturi effect is created by the high velocity, low pressure water flow. The low pressure zone draws water and any associated debris situated below the cleaner upwardly through the opening (inlet) and into the discharge conduit and filter bag. Although the water in the pool can be filtered by the prior art cleaner, such filtering is inefficient and expensive in terms of maneuverability, cleaning time and operating costs.

In particular, the necessity of using a garden hose from an external source to thereby induce a Venturi effect to draw pool water into the cleaner is inefficient and unwieldy to provide water. Residential water pressure is subject to unpredictable pressure drops and spikes from the main water supply or by actions induced by home owner while utilizing water at the home for other purposes, e.g., doing laundry, in-ground sprinkler systems, dishwashers, and the like. Thus, variations in water pressure can affect the operation of the cleaner and result in poor cleaning results and longer times to complete the manual cleaning of the pool. Accordingly, these inefficiencies increase the costs to operate the leaf vacuum cleaner. Further, the conventional garden hose when filled with water can be difficult to maneuver and is subject to kinking during the manual cleaning operation. Additionally, the required use of the garden hose with the cleaner results in the continuous addition of cold water to the pool, which can undesirably raise the water level height and lower the temperature of the pool water. The system is also wasteful of water, which may be a local environmental issue.

From the end user's perspective, the hose may not always be long enough to enable complete cleaning coverage of the pool. Adding extension hoses can be impractical as the added length can cause undesirable pressure drops, which diminish suction and cleaning of the pool. Accordingly, the end user must incur the additional expense of having to provide another local water supply closer to the pool. Further, end users have experienced poor performance with the cleaner while trying to maintain the cleaner in a position substantially parallel to the pool surface while maneuvering it with an extension pole, and at the same time with the garden hose dragging behind and resisting movement. As well, the user must connect to and disconnect the cleaner from the garden hose, which can become an annoyance every time the pool is being cleaned. In particular, the user may often experience the tedious and time consuming maintenance steps of always having to retrieve, uncoil, and attach the hose to the cleaner, and when finished, the reverse process of detaching, recoiling and storing the hose must then be performed. These time consuming maintenance steps can lessen the home owner's enjoyment of the pool.

Therefore, it is desirable to provide a manually operated pool cleaner for cleaning the bottom of a pool that is inexpensive to manufacture and operate, that is not affected by unpredictable water pressure changes, and that does not require the cumbersome and inconvenient use of any hose.

SUMMARY OF THE INVENTION

According to one aspect of the present invention, an electric-powered submersible vacuum cleaner for filtering water in a pool comprises a submersible housing having a base, a discharge conduit, and an outwardly extending flange, the base including an upper surface and a lower surface, the lower surface being positionable over a surface of the pool to be cleaned, and at least one opening extending through the upper and lower surfaces to define an inlet port; an impeller for drawing said water and debris from the surface of the pool; an electric-powered drive train configured to rotate the impeller; the discharge conduit having an upper portion and a lower portion, the lower portion being in fluid communication with the inlet port and extending substantially normal from the upper surface of the base, said discharge conduit circumscribing at least a portion of the impeller to direct the flow of water and debris drawn through the inlet by the impeller; a filter mounted to receive the water from over the discharge conduit and configured to filter the debris from the drawn water and pass filtered water into the pool; the outwardly extending flange extending from the upper portion of the discharge conduit and configured to secure the filter to the housing, wherein the impeller includes at least one blade having a leading edge and a trailing edge, the impeller being set at a height such that the leading edge of the at least one impeller blade is positioned to extend into the discharge conduit below a lower portion of the outwardly extending flange and the trailing edge of the at least one impeller blade extends above the lower portion of the outwardly extending flange; and a handle configured to attach to and facilitate manual movement of the submersible vacuum cleaner.

In one aspect, the electric-powered drive train is electrically coupled to a battery mounted on-board the vacuum cleaner. In another aspect, the battery is mounted to the base. In yet another aspect, the electric-powered submersible vacuum cleaner further comprises a battery chamber mounted to the base and configured to house at least one battery which is electrically coupled to the drive train.

In one aspect, the drive train includes an electric coupled to the impeller. In another aspect, the electric motor is coupled to the impeller via a rotatable drive shaft. Alternatively, the electric motor is coupled to the impeller via a transmission assembly. In yet another aspect, the electric-powered submersible vacuum cleaner further comprises a drive train mount assembly having a plurality of spaced apart support members, each support member having a lower end coupled to and extending upwardly from the upper surface of the base and an upper end configured to mount to and position the drive train and impeller in a direction normal to the surface of the base. In still another aspect, the transmission assembly includes a torque limiter assembly configured to regulate rotation of the impeller. In a further aspect, the torque limiter assembly is a clutch assembly. In yet another aspect, the torque limiter assembly includes an adjustable locking mechanism to manually set slippage.

In one aspect, the electric-powered submersible vacuum cleaner further comprises a plurality of rotationally-mounted supports extending from the lower surface of the base and configured to facilitate movement of the vacuum cleaner over the surface of the pool. In another aspect, the plurality of rotatably-mounted supports are adjustable to raise or lower the vacuum cleaner with respect to the surface of the pool. In still another aspect, the electric-powered submersible vacuum cleaner further comprises at least one brush mounted to the lower surface of the base and extending towards the surface of the pool.

In one aspect, the impeller is positioned at a predetermined height above the lower surface of the base. In another aspect, the impeller includes a conically shaped cap extending towards the surface of the pool.

In another aspect, the outwardly extending flange is further configured to decrease drag and direct flow of the water from the discharge conduit. In a further aspect, the outwardly extending flange is curved. In still another aspect, the filter includes an opening configured to circumscribe the discharge conduit beneath the outwardly extending flange. In another aspect, the discharge conduit includes at least one reinforcement member extending between the upper surface of the base and the outwardly extending flange.

In one aspect, the handle is rotatably attached to the base. In another aspect, the handle is lockable in a fixed position relative to the base. In still another aspect, the lockable handle is configured to remain in a locked state when the cleaner is inverted such that the inlet port is orientated upwards towards and draws debris proximate the surface of the water in the pool. In a further aspect, the handle includes a locking mechanism configured to remain in a locked state including when the cleaner is inverted such that the inlet port is orientated upwards towards and draws debris proximate the surface of the water in the pool.

In one aspect, at least a portion of the drive train is positioned coaxially above the discharge conduit.

In another embodiment, a submersible electrically powered vacuum cleaner for filtering water in a pool comprises: a submersible housing having a base and a discharge conduit, the base including an upper surface and a lower surface, the lower surface being positionable over a surface of the pool, and an opening extending through the upper and lower surfaces to define an inlet port; a plurality of rotationally-mounted supports extending from the lower surface of the base and configured to facilitate movement of the vacuum cleaner over a surface of the pool; an impeller for drawing said water and debris from the surface of the pool; an electric-powered drive train directly coupled to the housing and configured to rotate the impeller; the discharge conduit positioned above and in fluid communication with the inlet port and extending substantially normal with respect to the upper surface of the base, said discharge conduit circumscribing a first portion of the impeller to direct the flow of water and debris drawn through the inlet port by the impeller, and the discharge conduit having an outwardly extending flange circumscribing a second portion of the impeller, wherein the impeller includes one or more blades having a leading edge and a trailing edge, the impeller being set at a height such that the leading edges of the one or more impeller blades are positioned to extend into the discharge conduit below a lower portion of the outwardly extending flange and the trailing edges of the one or more impeller blades extend above the lower portion of the outwardly extending flange; a filter mounted to the housing over an outlet of the discharge conduit and configured to filter the debris from the drawn water and pass filtered water into the pool; and a handle configured to attach to and facilitate manual movement of the vacuum cleaner over the surface of the pool.

In one aspect, at least a portion of the drive train is positioned coaxially above the discharge conduit.

BRIEF DESCRIPTION OF THE DRAWINGS

FIGS. 12 and 13 are cross-sectional views of wheels collectively illustrating a second embodiment for adjusting the height of the vacuum cleaner with respect to a surface of the pool;

FIG. 14 is a top cross-sectional view of a spacer installed on a wheel caster shaft taken along lines 14-14 of FIG. 12 and which is suitable for adjusting and retaining the wheels of the cleaner at a predetermined height;

FIGS. 15 and 16 are cross-sectional views of the wheels collectively illustrating a third embodiment for adjusting the height of the vacuum cleaner with respect to a surface of the pool;

FIG. 17 is a top cross-sectional view of a spring fastener taken along lines 17-17 of FIG. 15 that is suitable for adjusting and retaining the wheels of the cleaner at a predetermined height.

To facilitate understanding of the invention, identical reference numerals have been used, when appropriate, to designate the same or similar elements that are common to the figures.

DETAILED DESCRIPTION OF THE INVENTION

Figure 1:
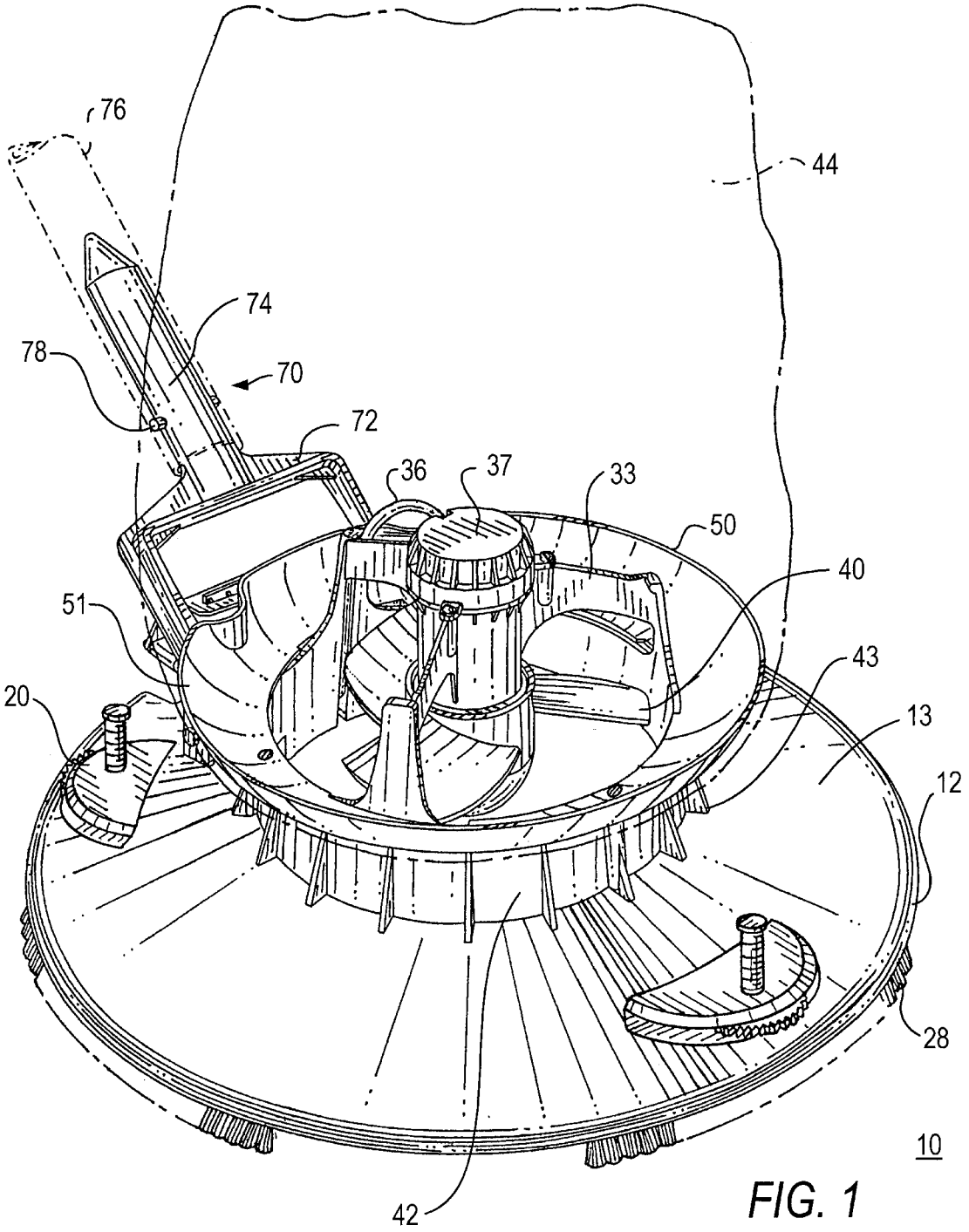
FIG. 1 is a top, front left side perspective view of an exemplary electric powered submersible vacuum cleaner of the present invention.
Figure 2:
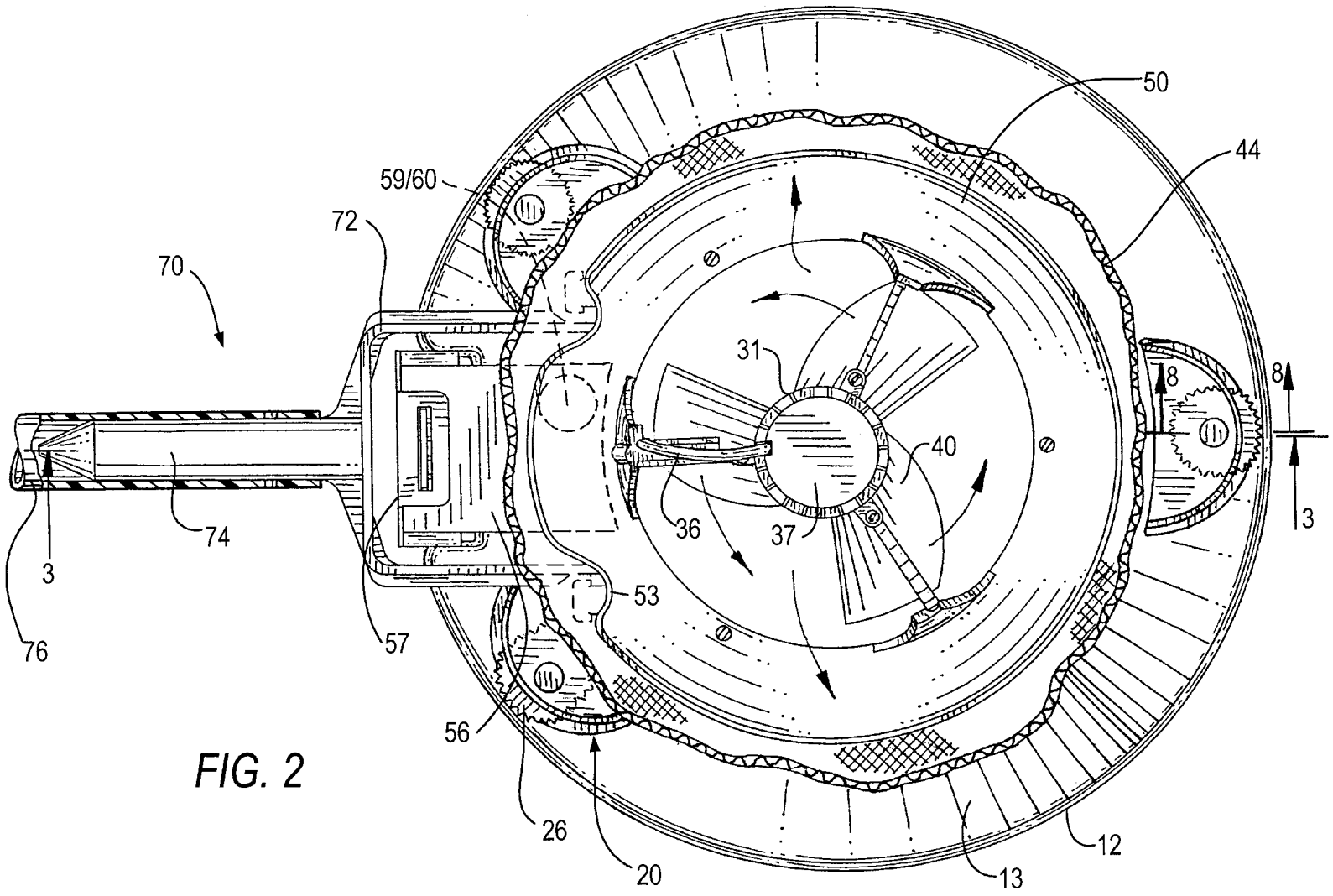
FIG. 2 is a top plan view of the electric-powered submersible vacuum cleaner of FIG. 1.

For purposes of illustration and clarity, the present invention is discussed in the context of a submersible vacuum cleaner for cleaning swimming pools. However, a person of ordinary skill in the art will appreciate that the cleaning device could also be used in small ponds or commercial tanks (e.g., fish farms) that are exposed to leaves and other debris from the surrounding environment.

The present invention includes an electric powered, submersible vacuum cleaner for removing debris from a surface of a pool. The cleaner is submersible in a water-filled pool, pond or tank, and includes an electrically driven impeller for drawing the pool water into the cleaner for filtering of debris, such as leaves and small twigs. The impeller is preferably driven by a drive train assembly that includes an electric motor and a transmission assembly, which includes meshing gears and/or a driveshaft to form a transmission for rotating the impeller in a desired clockwise or counter-clockwise direction at a slower rate than that of the electric motor but with increased torque. The transmission assembly also includes a torque limiter, illustratively in the form of a slip clutch, to permit the impeller to be coupled (engaged) with and decoupled (disengaged) from the electric motor. The torque limiter prevents debris from breaking a propeller blade and/or damage by overloading the electric motor, as well as serving as a safety feature to prevent injury to an operator of the leaf cleaning apparatus. The implementation of the electric driven impeller alleviates the need to utilize an unwieldy garden hose to supply water to the leaf vacuum cleaner to generate the suctional forces as required by the prior art cleaners. Moreover, the electric power is preferably provided to an impeller drive train locally from an on-board battery to thereby eliminate the need for an external power source and power cable.

Referring now to FIGS. 1-5, an exemplary submersible, electric powered vacuum cleaner 10 for cleaning a surface 3 of a pool 2 is illustratively shown. As shown in the drawings, the cleaner includes a base 12, a discharge conduit 42, a flexible mesh filter bag 44, an impeller 40, and an electric drive train assembly 30 for rotating the impeller 40, to thereby draw water and debris from below the cleaner 10 through the inlet 16, the discharge conduit 42 and into the filter bag 44, where the debris is retained and the filtered water is discharged back into the pool 2.

The base 12 includes an upper surface 13 and a lower surface 15, and a channel or opening 14 to define the inlet port 16. Thus, the base 12 is illustratively shown as being an annular ring. However, the shape of the base 12 is not considered limiting. For example, the shape of the base 12 can be rectangular, triangular, oval or any other shape having an inlet port 16 extending therethrough. The inlet port 16 is configured and positioned in alignment with the electrically driven impeller 16, as described below in greater detail.

The discharge conduit 42 extends upwardly from the upper surface 13 of the base and is in fluid communication with the inlet 16. Preferably, the interior surface 47 of the discharge conduit 42 is configured in size and shape to correspond to the opening 14 forming the inlet port 16, as shown in the drawings. Attached to or about the upper end of the discharge conduit 42 is an outwardly or radially extending flange 50. The flange 50 preferably includes upwardly curved interior and exterior surfaces 51 that are smooth to decrease drag and direct the flow of the water so that the debris does not get lodged in the discharge conduit 42. The flange 50 is also provided to retain the filter bag 44 in position around the discharge conduit 42.

Figure 4:
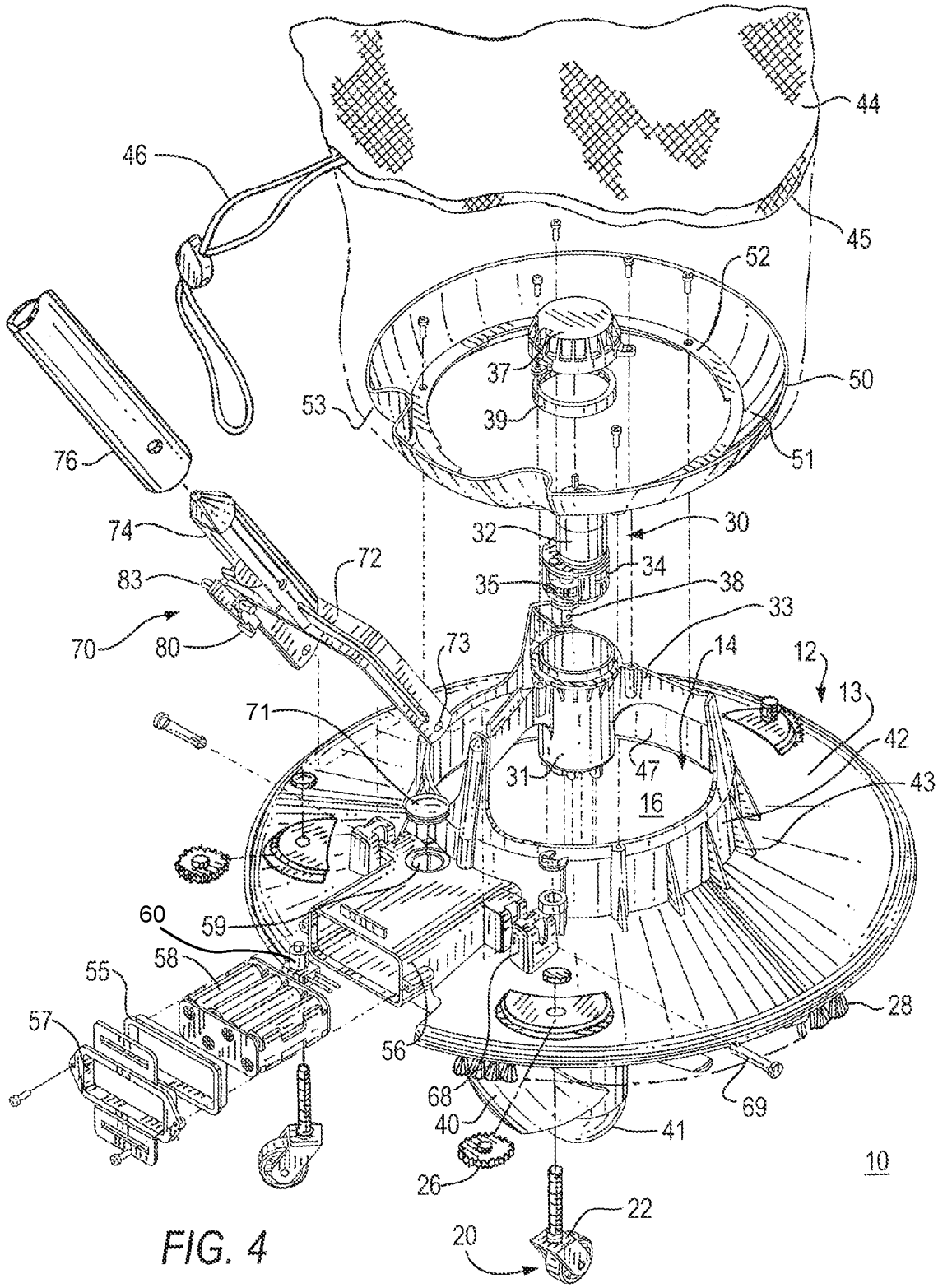
FIG. 4 is an exploded view of the electric-powered submersible vacuum cleaner of FIG. 1.
Figure 5:
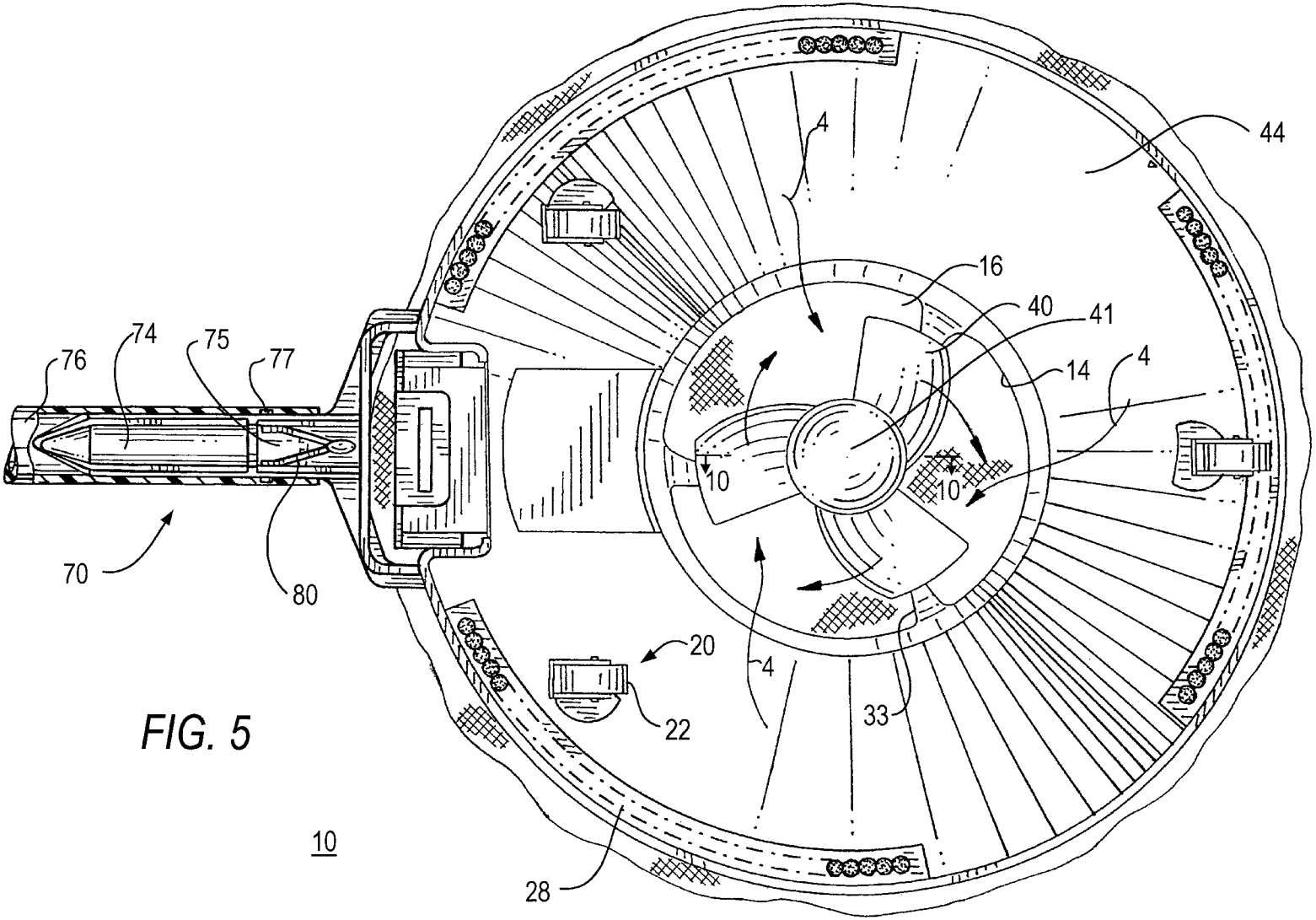
FIG. 5 is a bottom plan view of the electric-powered submersible vacuum cleaner of FIG. 1.

Referring to FIG. 4, the outwardly extending flange 50 is illustratively shown as being attached to the top portion or edge of the discharge conduit 42 by one or more fasteners (e.g., screws, adhesive, among other conventional fasteners). However, a person of ordinary skill in the art will appreciate that the flange 50 can be formed integrally with the discharge conduit 42. Moreover, the discharge conduit 42 is shown as being integrally formed with the upper surface 13 of the base 12. A person of ordinary skill in the art will appreciate that the discharge conduit 42 can be a separate component and fastened to the upper surface 13 of the base 12 via one or more fasteners, such as with screws, bolts, or an adhesive, among other conventional fasteners.

In an embodiment where the discharge conduit 42 is integrally formed with the base 12, a plurality of reinforcing members 43 can be provided to extend vertically between the upper surface 13 of the base 12 to the lower surface of the outwardly extending flange 50. The reinforcing members 43 are optionally formed along the exterior surface of the discharge conduit to provide additional structural support.

The filter 44 is preferably fabricated as a flexible mesh bag having an opening 45 with an elastic cinch or manual draw string 46 to facilitate adjustment of the size of the opening. The end of the filter forming the opening 45 of the bag is placed over the outwardly extending flange 50 such that the filter end and draw string 46 circumscribe the exterior surface of the discharge conduit 42. The cleaner operator tightens the draw string 46 so that the filter opening 45 wraps closely around the exterior surface of the discharge conduit 42 and is positioned beneath the outwardly extending flange 50. The outwardly extending flange 50 thereby acts as a block to prevent the filter bag 44 from sliding or slipping upwards and off the discharge conduit 42.

The flexible mesh filter bag 44 can also be supported by one or more flexible frame members that are placed inside the bag to serve as a structural frame, and can be optionally retained in channels formed by sewing the filter bag material in a manner similar to that used to support camping tents. Alternatively, a skeletal structure can be inserted into the interior of the filter bag to expand and support it in a predetermined defined shape. The frame members or skeletal structure can be fabricated from integrally molded plastic, aluminum, stainless steel, among other durable, non-corrosive, UV resistant materials.

Figure 3:
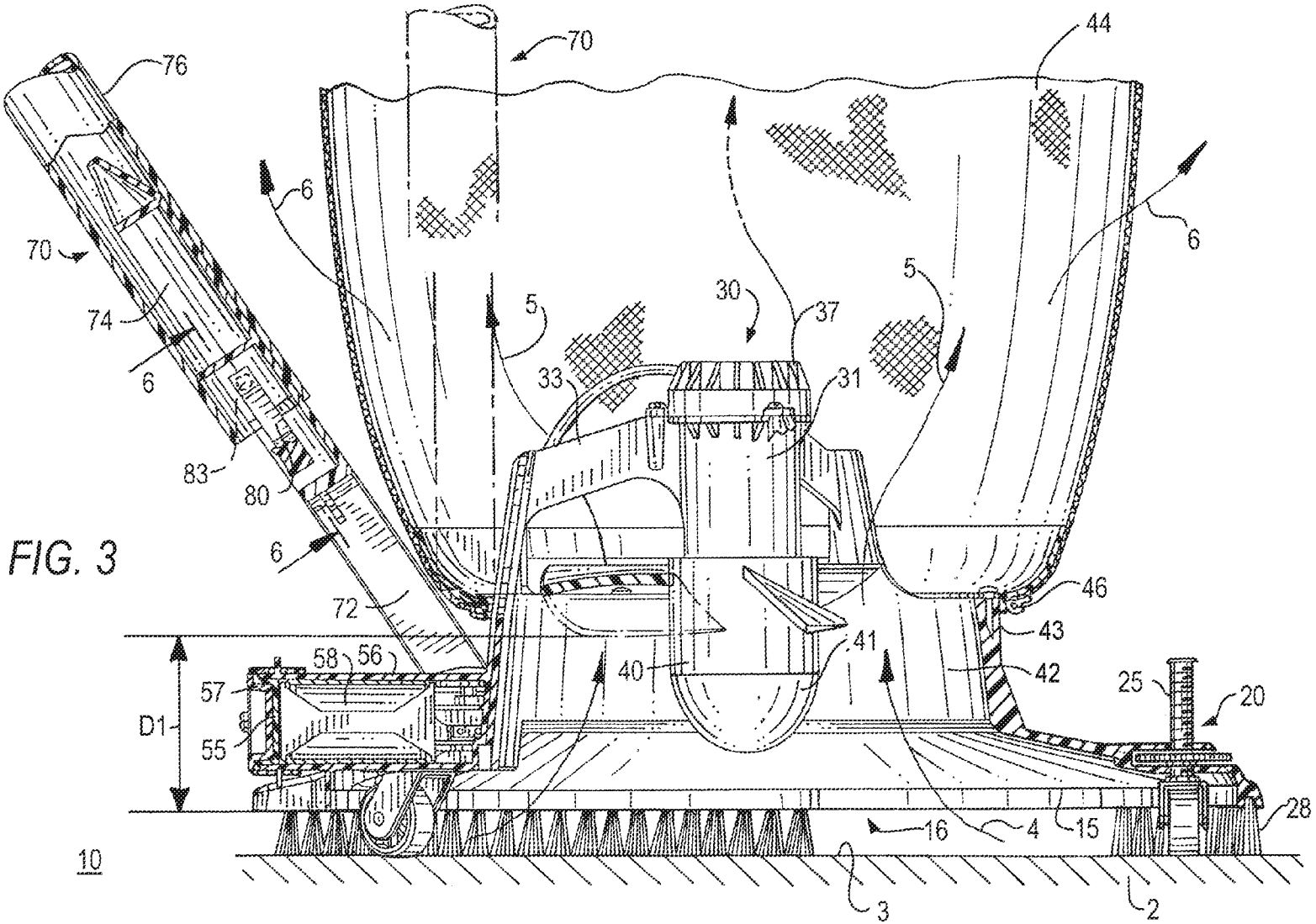
FIG. 3 is a cross-sectional view of the electric-powered submersible vacuum cleaner taken along lines 3-3 of FIG. 2.

Referring now to FIGS. 1, 3 and 4, the drive train assembly 30 is positioned coaxially above the inlet 16 and the upper end of the discharge conduit 42 by a plurality of evenly spaced support members 33. The drive train assembly 30 includes a drive train housing 31 for facilitating and securely positioning an electric motor 32, transmission 34, and the impeller 40 over the inlet 16. The electric motor 32 includes a drive shaft that rotates a driving gear or first gear box of the transmission 34, which drives one or more driven gears to rotate the impeller 40 at a predetermined rotational rate, as discussed below in further detail.

As illustratively shown in the drawings, three support members 33 are equidistantly spaced about the upper end of the discharge conduit. By minimizing the number of support members 33, obstruction to the discharge conduit 42 can be minimized to thereby allow the water and debris to flow substantially unimpeded into the filter bag 44. In one embodiment, the lower ends of the support members are coupled to the upper end of the discharge conduit 42 while the upper ends of the support members 33 are coupled to the drive train housing 31. Three support members 33 are preferably used for a circular-shaped cleaner 10 to minimize obstructing the flow of water and debris from the inlet 16 into the filter bag 44, although the number of support members 33 is not considered limiting. Preferably, each support member 33 also has a narrow width that is sized to minimize its obstruction of the flow of water and debris from the inlet 16 into the filter bag 44. Preferably, the width of each support member 33 is in a range of 1/16 to 1/8 inches, although such dimensions are not considered as being limiting. As shown in the drawings, the lower ends of the support members 33 are illustratively integrally attached to the upper surface of the discharge conduit 42. Alternatively, the lower ends of the support members 33 can be attached to the upper surface of the discharge conduit 42 by a fastener (e.g., bolt, screw, adhesive, etc.). In either embodiment, the outwardly extending flange 50 circumscribes the discharge conduit 42 and the support members 33. In yet another embodiment, the lower ends of the support members 33 can be attached along the interior portion 52 (see FIG. 4) of the upper surface of the outwardly extending flange 50. In this manner, the outwardly extending flange 50 can also circumscribe the discharge conduit 42 and the support members 33.

As shown in FIG. 4, the electric motor 32 is positioned over and drives the transmission 34, which in turn rotates the impeller 40 at a predetermined rate. The electric motor 32 and transmission 34 are positioned longitudinally into an opening formed at the top of the drive train housing 37 and the housing opening can be closed to form a water-tight drive train compartment using an end cap 37 with a seal 39, such as an O-ring, gasket, and the like.

In one embodiment, the electric motor 32 is a direct current (DC) motor that receives direct current from one or more batteries. The DC motor can illustratively be a RS-365 DC motor operating at 12 volts and can have a power rating in the range of 5 to 10 Watts with a rotational frequency of 8000 rpm to 10,000 rpm. Alternatively, where the power to the electric motor 30 is provided externally from an alternating current (AC) source, the electric motor can be an AC motor having similar specifications.

The transmission 34 drives and regulates the rotational speed of the impeller 40. In particular, the transmission 34 reduces the higher motor speed to the slower impeller speed, increasing the torque in the process. Preferably, the transmission 34 produces a torque output in the range of 600 to 1,000 mN-m, and the impeller 40 rotates at a rate in a range of 200 to 250 rpm, which enables the cleaner to draw the water and heavier debris, such as leaves and twigs from beneath the lower surface 15 of the cleaner 10, with enough torque power to mulch leaves and other such debris. A person of ordinary skill in the art will appreciate that the operational specifications provided herein for the electric motor 32 and transmission 34 are for illustrative purposes and are not considered limiting. Additionally, although the impeller 40 is illustratively depicted with three blades, the number of blades of the impeller is not considered limiting.

The drive train assembly 30 includes a torque limiter assembly 35 which can limit the speed and/or disengage the impeller 40 from the electric motor 32 and/or driving portion of the transmission 34. The torque limiter assembly 35 can be provided by implementing a friction plate slip clutch, a thrust bearing with a spring (e.g., silicone spring), synchronized magnets, a pawl and spring arrangement, among other conventionally known torque limiters. In any embodiment, the torque limiter 35 will disengage the motor drive shaft from the impeller 40 in the unlikely event the impeller 40 becomes overloaded or jammed by the debris.

Figure 10:
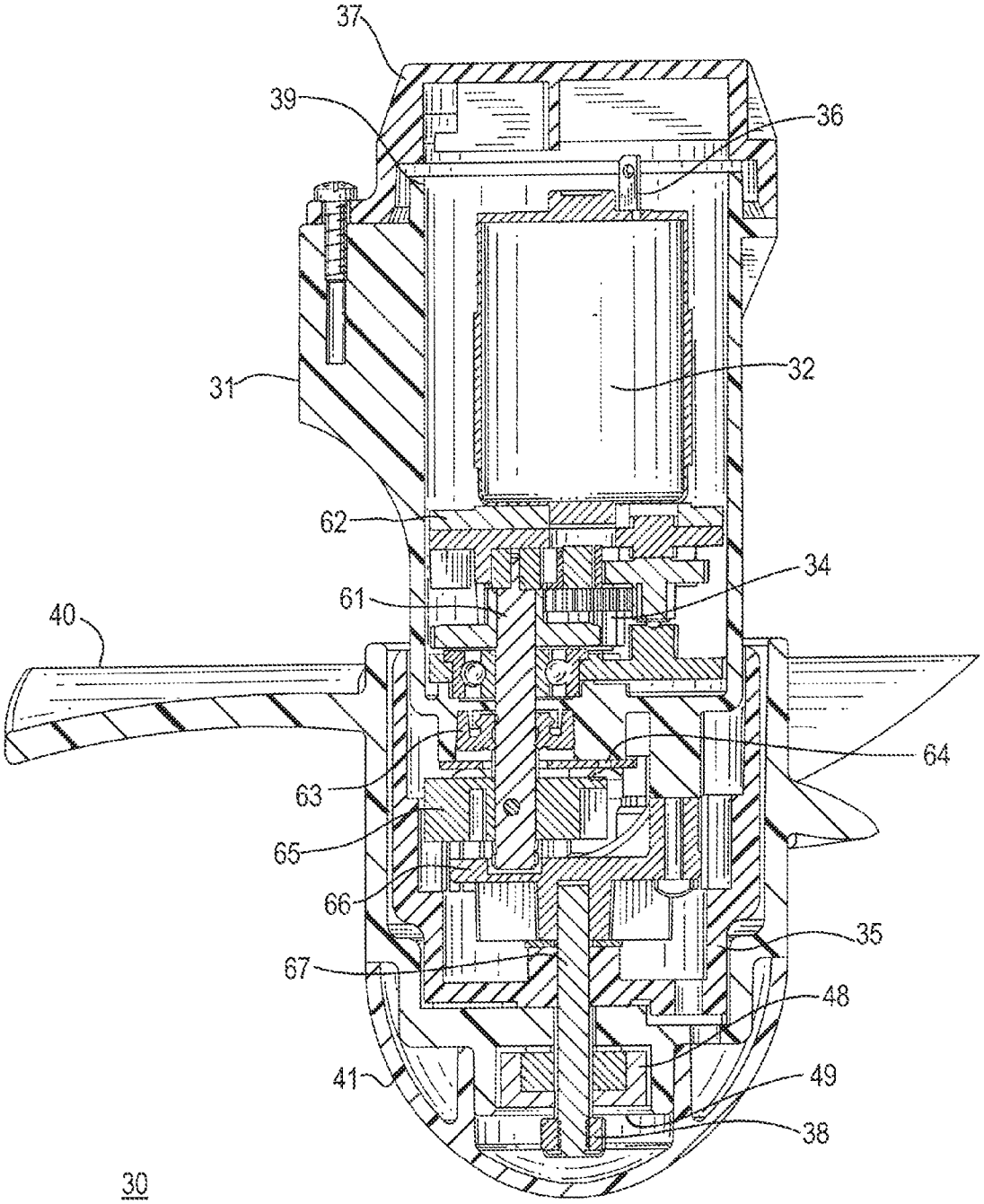
FIG. 10 is a cross-sectional view of a drive train assembly taken along lines 10-10 of FIG. 5.
Figure 11:
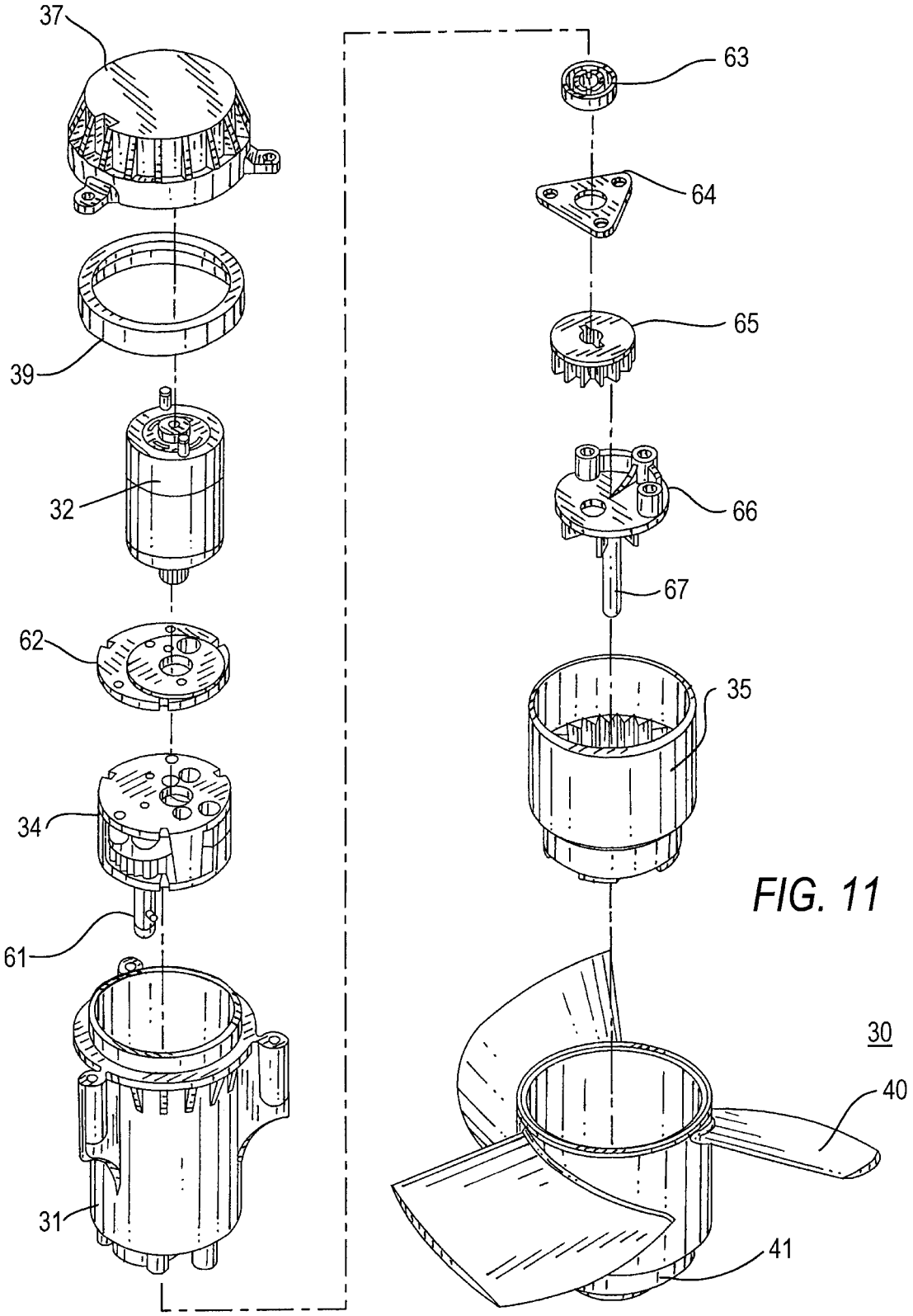
FIG. 11 is an exploded view of the drive train assembly of FIG. 10.

Referring now to FIGS. 10 and 11, preferably the drive train assembly 30 includes the electric motor 32 (e.g., DC motor) which is mounted upright in the drive train housing 31 by a motor mount 62. A lower downward extending gear of the electric motor 32 interfaces with a gear box of the transmission 34 to reduce the rotational speed of the electric motor 32 and increase the torque to the impeller 40. The gear box includes a series of serially meshed gears (e.g., four gears), the first which interfaces with the electric motor 32 and the last of which further includes a shaft 61, which extends vertically downward towards the impeller. The vertically extending shaft 61 rotates a spur gear 65. Preferably, the shaft 61 and spur gear 65 include a keying arrangement (e.g., pin and corresponding slot) that lock together to enable the spur gear 65 to rotate at the same rotational rate as the last gear of the gear box. The spur gear 65 engages with and rotates the torque limiter (e.g., clutch mechanism) 35, which circumscribes an impeller shaft 67. The clutch 35 is cylindrical and includes a plurality of teeth formed on an interior surface thereof. The impeller shaft 67 is fixedly mounted to an impeller shaft mount 66 which is also fixedly mounted in the drive train housing 31. The spur gear 65 is illustratively positioned off-center between the stuffing box cover 64 and the upper end of the impeller shaft mount 66 so that it engages and meshes with the teeth formed on an interior surface of the cylindrical clutch 35.

The impeller 40 circumscribes the clutch assembly 35. The cylindrical clutch has a lower edge with a plurality of angled teeth which interface with a corresponding interior surface of the impeller 40. During unimpeded operation, the clutch assembly 35 and impeller 40 contemporaneously rotate about the fixed impeller shaft 67.

In one embodiment, the torque limiter assembly 35 includes an adjustable locking mechanism 38 to enable the manufacture and/or cleaner operator to manually set slippage. The adjustable locking mechanism 38 is preferably a lock nut which can be manually rotated to increase or decrease the slippage. Preferably the lock nut can only be tightened to a predetermined limit to thereby prevent the operator from over-tightening the clutch mechanism and potentially causing damage to the transmission.

Referring now to FIG. 10, an illustrative clutch spring 48, washer 49 and locking nut 38 are arranged to collectively exert an upward force against the bottom of the impeller to apply and selectively adjust the interactive forces as between the angled teeth of the clutch assembly 35 and the corresponding angled interior surface of the impeller 40. More specifically, the locking nut 38 is used to adjust the tension of the spring 48, which in turn regulates the slippage of the clutch 35. Accordingly, the clutch 35 will disengage from the impeller 40 upon an external force stopping or otherwise impeding the rotation of the impeller 40. For example, if an external force from the debris (e.g., a branch from a tree) is applied to the blades that impedes or stops the rotation of the impeller 40, once the external force exceeds the predetermined tension of the spring 48 (as selectively set by the locking nut 38), the clutch 35 will disengage from the impeller 40 and the motor 32 will spin freely and out of harm's way from the undesirable loading (blockage) of the impeller 40.

Referring now to FIG. 3, the pool water beneath the lower surface 15 of the base 12 is drawn into the inlet 16 as illustrated by arrows 4, and flows through the discharge conduit 42 and into the filter bag 44 as illustrated by arrows 5, and the filtered water exits the filter bag 44 back into the pool as illustrated by arrows 6. Preferably, the impeller 40 is positioned at a predetermined height D1 above the lower surface 15 of the base 12. The impeller blades are raised above the inlet opening to better channel the water and debris through the inlet 16. In particular, as shown in FIG. 3, the impeller 40 is positioned at a height D1 such that the leading edges of the propeller blades extend into the discharge conduit 42 below the lower portion of the radially extending flange 50 and the trailing edges of the impeller blades extend above the lower portion of the radially extending flange 50. The height D1 of the blades with respect to the lower surface 15 of the base 12 is preferably in a range of approximately 3.25 to 3.75 inches (approx. 8 to 9.5 cm), although such height is not considered limiting.

Preferably, the impeller 40 includes a conically shaped cap 41 to prevent debris from getting caught in a dead zone beneath the impeller and further produce a more streamlined flow of water and debris into the inlet 16. The cap 41 can be integral with the impeller 40 or be attached by a threaded connection or other fastener.

Power to the electric motor 32 is preferably provided by an on-board battery 58. In one embodiment the battery 58 is a 12v supply that can be provided from a pack of batteries, such as eight 1.5v, AA size batteries, although such battery voltage and pack configuration is not considered limiting. The battery 58 can be one or more rechargeable batteries, such as NiMH rechargeable batteries, although such types of batteries are not considered limiting. The battery 58 is retained in a battery housing 56 which is illustratively attached to the upper surface 13 of the base 12 of the cleaner 10, as shown in the drawings. A person of ordinary skill in the art will appreciate that the battery housing 56 can be integral to the base 12 or attached to the base or other exterior location of the cleaner by one or more fasteners. As shown in FIG. 4, the battery pack 58 is inserted into a compartment of the battery housing 56 and is covered by a cover 57 and seal 55 (e.g., gasket, O-ring, and the like) to form a watertight battery compartment. The battery housing 56 includes electrical contacts and one or more conductors 36 that provide electric power to the electric motor 32.

A switch 60 is provided to enable an operator to activate the electric motor 32 and operate the cleaner 10. As shown in FIG. 4, a push button 71 of the power switch is installed in a switch receptacle 59 formed in the battery housing 59. The power switch 60 can be depressed by the operator to enable electric power to flow from the battery 58 to the motor 32, which in turn rotates the impeller 40 (e.g., via the transmission 34). Depressing the power switch 60 again will disable power to the electric motor 32. Alternatively, a toggle switch or other conventionally known switch can be implemented to activate/deactivate power flow from the battery 58 to the electric motor 32.

In an alternative embodiment, the battery 58 can be positioned remotely from the vacuum cleaner 10 and power is provided from the remote battery via a power cable (not shown) that is coupled between the remote battery source and the electric motor 32. In yet another embodiment, the electrical power can be provided from a remote AC power source, such as a 120 Vac, 60 Hz power source, which provides AC power to the electric motor of the cleaner via a power cable. In this latter embodiment, the electric motor 32 is an AC motor.

Movement of the cleaner 10 over the surface 3 of the pool 2 is enabled by providing a plurality of rotationally-mounted supports 20 and a handle assembly 70 for enabling manual control of the cleaner 10. Referring to FIGS. 3, 4, 8 and 9, the rotationally-mounted supports 20 are preferably wheels 22 which are illustratively mounted on casters 24. In particular, each caster wheel includes a shaft 23 which extends upright through a bore formed through the upper and lower surfaces of the base 12. Preferably, the height of the wheels can be adjusted with respect to the lower surface 15 of the base 12. In one aspect, the shaft 23 is threaded and a corresponding threaded height adjustment wheel 26 can be turned to adjust the height. This enables the user to set the height to avoid contact with obstructions projecting above the bottom surface, such as water inlet covers, light housings and the like which are commonly found in pools and tanks.

Figure 9:
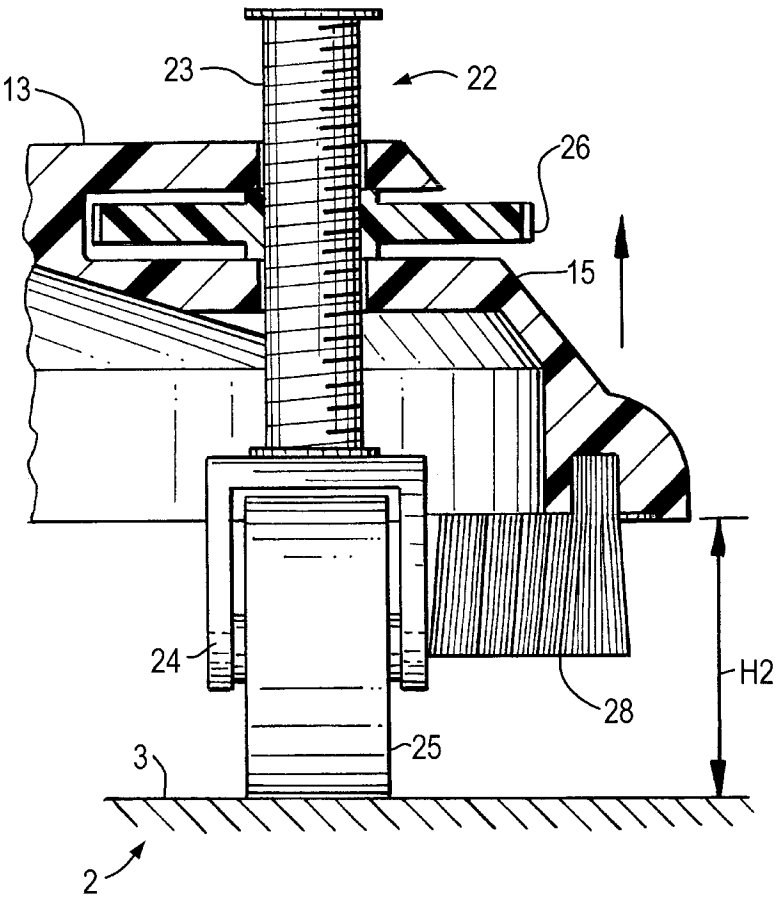
FIGS. 8 and 9 are cross-sectional views of the wheels taken along lines 8-8 of FIG. 2 collectively illustrating a first embodiment for adjusting the height of the vacuum cleaner with respect to a surface of the pool.
Figure 8:
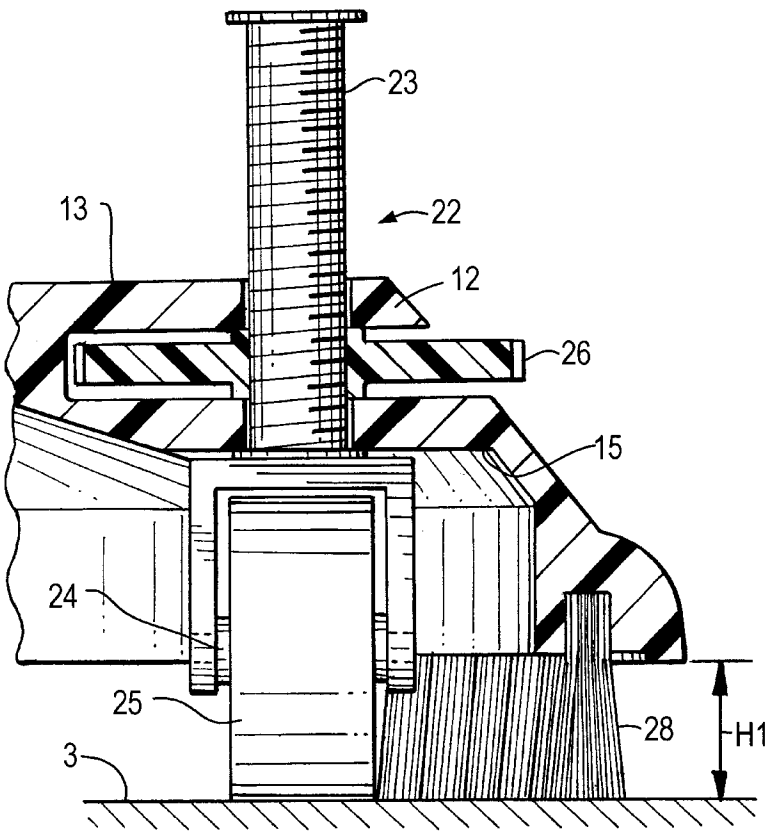

Referring now to FIGS. 8 and 9, each caster wheel 22 is separately adjusted to a height H1 or H2 by turning the threaded height adjustment wheel 26 in a clockwise or counter-clockwise direction. For example, in FIG. 8, the caster wheel 22 is illustratively adjusted to a lowest position by rotating the threaded height adjustment wheel 26 in a counter-clockwise direction. The height H1 illustrates the lowest distance that the bottom of the cleaner is positioned over the surface 3 of the pool 2. Referring to FIG. 9, the caster wheel 22 is set at an intermediate position by rotating the threaded height adjustment wheel 26 in a clockwise direction such that the cleaner is raised higher above the surface 3 of the pool 2 at a height H2, where H2 is greater than H1. Preferably, the height H of the cleaner with respect to the surface 3 of the pool 2 can be lowered and raised in a range of approximately 0.5 to 1.0 inches (approximately 1.2 to 2.5 cm) from the surface 3 of the pool 2, although such heights are not considered limiting.

Although the cleaner is discussed as having caster wheels with threaded shafts 23, such configuration is not to be considered limiting, as a person of ordinary skill in the art will appreciate that the rotationally-mounted supports can be rollers, and the like. Moreover, other fasteners can be implemented to set the height of the cleaner. For example, each shaft 23 can be unthreaded and include one or more bores to receive a corresponding pin to adjust the height H of the cleaner 10 with respect to the surface 3 of the pool 2.

Referring now to FIGS. 12-14, in an alternative embodiment a relocatable spacer 21 is provided to adjust the height H of the cleaner 10 with respect to the surface 3 of the pool 2. In particular, the base 12 includes a plurality of substantially upright channels 11, each of which is configured to receive and secure the shaft 23 of the caster wheel assembly 24. The shaft 23 is unthreaded and has a height that is greater than the height of the channel 11 and a relocatable spacer 21 can be positioned at the top or bottom of the channel to respectively lower or raise the height of the base 12 of the cleaner from the surface 3 of the pool 2. In FIG. 12, the spacer 21 is positioned above the channel 11 and is held in position by a locking washer or flange 25, which is secured about the top portion of the shaft 23 in a well-known manner. The spacer 21 is illustratively a flexible C-shaped spacer which can be readily snapped on and off about the diameter of the shaft 23 to adjust the height. In FIG. 12, the height H1 of the base 12 is lowered by placing the spacer 21 at the top of the shaft 23. Alternatively, as illustratively shown in FIG. 13, the height H2 of the base 12 is raised by positioning the spacer 21 proximate the bottom of the shaft 23, e.g., between the bottom of the channel 11 and the top of the caster bracket 24. A person of ordinary skill in the art will appreciate that the shape of the spacer 21 is not considered limiting and the locking washer 25 can be permanently or removably attached to the top of the shaft 23 to retain the spacer 21 at its intended position.

Referring now to FIGS. 15-17, in yet another embodiment, each shaft 23 is unthreaded and includes a plurality of grooves 27, wherein each groove 27 is sized to receive a spring fastener 29, such as an E-ring fastener. A coil spring 19 circumscribes the shaft 23 of the caster wheel assembly, and both the shaft 23 and coil spring 19 extend through the channel 11. In FIG. 15, the spring fastener 29 is removably attached about a first lower groove 27 formed on the shaft 23. In this first illustrative position, the coil spring 19 is compressed between the top of the channel 11 and the caster bracket 24, and the base 12 of the cleaner is lowered to a height H1. In FIG. 16, the removable spring fastener 29 is snap-fit about a groove 27 that is positioned higher than the first lower groove. In this second illustrative position, the coil spring 19 is expanded between the top of the channel 11 and the caster bracket 24, and the base 12 of the cleaner is now raised to a new height (e.g., height H2 or H3) above the surface 3 of the pool 2. A person of ordinary skill in the art will appreciate that the number of grooves 27 and the shape of the spring fastener 29 are not limiting.

In an embodiment, the vacuum cleaner 10 can include one or more brushes 28 affixed to the bottom surface 15 of the base 12. The brushes 28 are preferably removably attached to the bottom surface 15 of the base 12, although the attachment to base is not considered limiting. The brushes 28 are provided to stir up and sweep the debris from the surface 3 of the pool 2 and preferably direct the debris towards the inlet 16. Raising the height of the cleaner 10 with respect to the surface 3 of the pool 2 will reduce the amount of sweeping/stirring action by the brushes 28, as well as reduce the suction created by the impeller 40. Conversely, lowering the cleaner 10 with respect to the surface 3 of the pool 2 will increase the amount of sweeping/stirring action by the brushes 28, as well as increase the suction created by the impeller 40.

Referring now to FIGS. 3 and 4, a handle assembly 70 is provided to enable a user to push and pull the cleaner 10 along the bottom surface 3 of the pool 2. The handle assembly 70 is preferably pivotally attached to the base 12 to facilitate greater maneuverability of the cleaner by the operator.

Referring to FIG. 4, the handle assembly 70 includes a U-shaped or C-shaped bracket 72 having opposing ends that are pivotally attached to corresponding handle mounts 68 formed on the base 12 of the cleaner 10. As shown in the drawings, a handle mount 68 is provided along each side of the battery housing 56, and each handle mount includes a bore sized to receive a corresponding fastener, such as a pin 69. Each opposing end of the U-shaped bracket 72 also includes a bore 73 sized to receive the pin 69. Each opposing end of the U-shaped bracket 72 is aligned and pivotally mounted to a corresponding handle mount. In particular, the bore in each end of the U-shaped bracket 72 is aligned with a corresponding bore formed in the handle mounts 72, and the pin 69 extends through both adjacent bores and secures the bracket 72 to base 12 via the handle mounts 72. The dimensions (e.g., width) of the U-shaped bracket 72 corresponds to the dimensions (e.g., width) of the battery housing 56 to permit the handle assembly 70 to clear the battery housing 56 while being rotated. Preferably, the handle assembly 70 can be pivotally rotated about the handle mounts approximately ninety degrees, although the degrees of rotational movement are not considered limiting. In one embodiment, recesses 53 can be provided in the outwardly extending flange 50 to increase the degrees of rotational movement of the handle assembly 70.

The U-shaped bracket 72 further includes an elongated shaft 74 that extends in an opposite direction with respect to the opposing ends of the U-shaped bracket 72. The elongated shaft 74 is configured to receive and secure an extension pole 76, which has a length sufficient to enable the operator to stand along the side of the pool and maneuver the cleaner over the surface 3 of the pool 2. In one embodiment, the elongated shaft is equipped with a spring mechanism or fastener for removably attaching and detaching the extension pole 76.

Referring to FIGS. 1-5, the extension pole 76 is tubular and includes a lower end having pair of opposing bores 77. The tubular extension pole 76 is sized to receive the elongated shaft 74 in a close fitting relation and is retained thereto by the spring mechanism 78 which serves as a fastener. The elongated shaft 74 includes an upper end having a channel 75 for receiving the spring mechanism, such as a snap clip 80, and opposing bores 79 that align with the opposing bores 77 of the extension pole 76.

Figure 7:
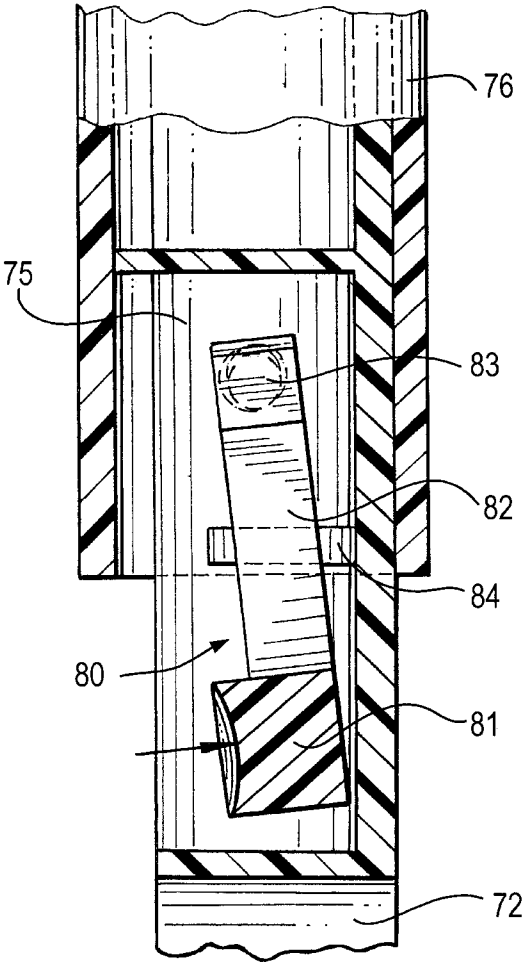
FIG. 7 is a cross-sectional view of the handle assembly taken along lines 7-7 of FIG. 6.
Figure 6:
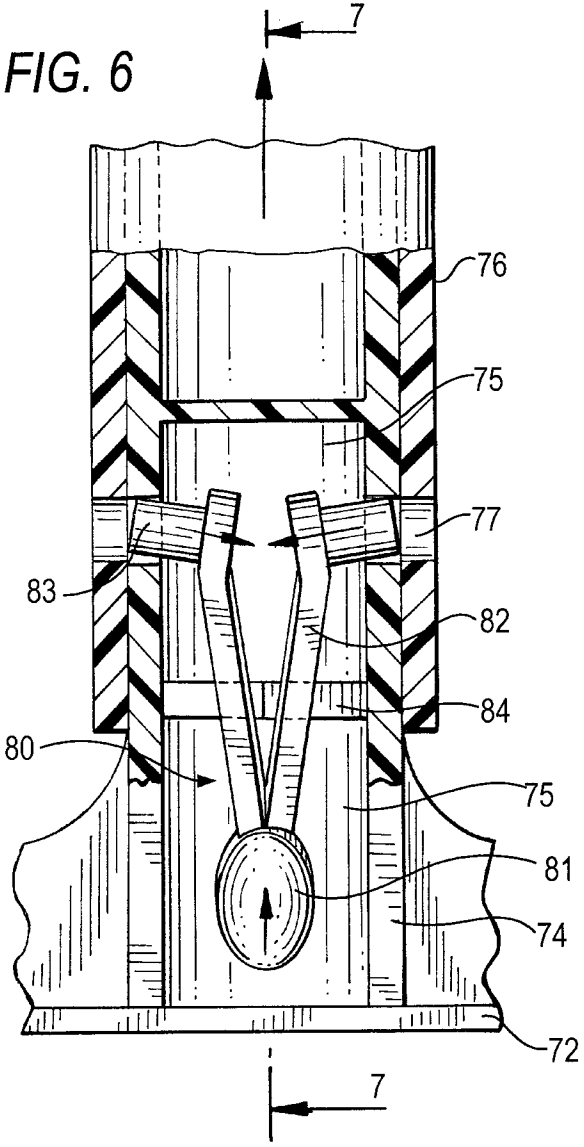
FIG. 6 is a cross-sectional view of a handle assembly of the electric-powered submersible vacuum cleaner taken along lines 6-6 of FIG. 3.

Referring to FIGS. 6 and 7, the snap clip 80 is pivotally seated within the channel 75 of the elongated shaft 74. The snap clip 80 is a V-shaped spring 82 having a vertex 81 forming a proximal end and a pair of distal ends, each distal end having a retention pin 83 extending outwardly in an opposite direction from the other. Each retention pin 83 movably engages with a corresponding one of the bores 77. In particular, the channel 75 includes a lateral V-shaped ridge or member that is positioned proximately between the vertex 81 and distal ends of the V-shaped spring 82. The retention pins 83 of the V-shaped spring 82 extend through the aligned bores 79 and 77 of the elongated shaft 75 and extension pole 76. When the V-shaped spring 82 is depressed so that it slidably engages the lateral V-shaped ridge 84 formed in the channel 75, the distal ends of the spring 82 and the opposing pins 83 retract inwardly to disengage the pins 83 from the outer bore 77 formed in the extension pole 76. The pins 83 are sized to continue to engage and pivot within the inner bores 79 of the extension shaft 74 when the spring clip is depressed and retracted from the outer bores 77. In this manner, by depressing the vertex of the snap clip 80, the operator can easily attach or release the extension pole 76 from the U-shaped bracket 72. Although the handle assembly 70 is illustratively shown with an extension pole that is attached by a snap clip 80, a person of ordinary skill in the art will appreciate that other fasteners 78 can be implemented to removably secure the extension pole 76.

Accordingly, the present invention overcomes the deficiencies of the prior art by providing an electric powered, submersible vacuum cleaner for cleaning debris from a surface of a pool. The electric powered submersible vacuum cleaner preferably includes an on-board battery that provides power to rotate an impeller via a drive train. Advantageously, the electric driven impeller draws water into the cleaner for filtering without having to utilize an external water source through a garden hose, as seen in the prior art. Therefore, the unwieldy use of the garden hose, as well as unpredictable and undesirable changes water pressure is completely avoided.

Moreover, the drive train includes an electric motor and a transmission assembly which controls the rotational speed of the impeller and advantageously provides sufficient torque to draw water into the cleaner and mulch debris, such as leaves and twigs into smaller particles for filtering. The ability to draw water into the leaf vacuum by using an impeller along with the ability to mulch the debris is a significant improvement over the prior art leaf vacuum cleaners. A further advantage of the present invention is the implementation of a torque limiter for user safety and which can prevent damage to the electric motor in the event the impeller becomes overloaded or jammed by the debris.

The electric drive train is preferably driven by one or more batteries, and the transmission of the drive train provides significant gear reduction to produce a low rpm and high torque cleaning operation. The low rpm and high torque operation helps assure low power draw from the batteries to lengthen their battery life.

The foregoing specific embodiments represent just some of the ways of practicing the present invention. For example, the battery pack can be remotely coupled to the cleaner with a wire cable to enable a user to separately carry the battery pack illustratively in a pouch (e.g., fanny pack) or other well-known manner. In yet another embodiment, the handle assembly can be locked so that it extends substantially straight and does not rotate vertically up and down 90 degrees from the base. By locking the handle assembly in a fixed position, the leaf vacuum cleaner can be flipped upside down by rotating the extension pole laterally one hundred and eighty degrees, such that the inlet port faces upwards towards and clean debris from the surface of the water. Moreover, a person of ordinary skill in the art will appreciate that the leaf vacuum cleaner of the present invention can be mounted on a floatation device, such as an inner tube so that the inlet port is configured to skim and remove any floating debris from the waterline surface of the pool. In this embodiment, the floating leaf vacuum cleaner does not need to be pushed around and can simply circulate, illustratively, from the currents created by the pool's main filtering system.

Many other embodiments are possible and it will be apparent to those of ordinary skill in the art from this disclosure of the invention. Accordingly, the scope of the invention is not limited to the foregoing specification, but instead is to be determined by the appended claims along with their full range of equivalents.

What is claimed is:

1. An electric-powered submersible vacuum cleaner for filtering water in a pool comprising:

a submersible housing having a base, a discharge conduit, and an outwardly extending flange, the base including an upper surface and a lower surface, the lower surface being positionable over a surface of the pool to be cleaned, and at least one opening extending through the upper and lower surfaces to define an inlet port;

an impeller for drawing said water and debris from the surface of the pool;

an electric-powered drive train configured to rotate the impeller;

the discharge conduit having an upper portion and a lower portion, the lower portion being in fluid communication with the inlet port and extending substantially normal from the upper surface of the base, said discharge conduit circumscribing at least a portion of the impeller to direct the flow of water and debris drawn through the inlet by the impeller;

a filter mounted to receive the water from over the discharge conduit and configured to filter the debris from the drawn water and pass filtered water into the pool;

the outwardly extending flange extending from the upper portion of the discharge conduit and configured to secure the filter to the housing, wherein the impeller includes at least one blade having a leading edge and a trailing edge, the impeller being set at a height such that the leading edge of the at least one impeller blade is positioned to extend into the discharge conduit below a lower portion of the outwardly extending flange and the trailing edge of the at least one impeller blade extends above the lower portion of the outwardly extending flange; and a handle configured to attach to and facilitate manual movement of the submersible vacuum cleaner.

2. The electric-powered submersible vacuum cleaner of claim 1, wherein the electric-powered drive train is electrically coupled to a battery mounted on-board the vacuum cleaner.

3. The electric-powered submersible vacuum cleaner of claim 2, wherein the battery is mounted to the base.

4. The electric-powered submersible vacuum cleaner of claim 3 further comprising a battery chamber mounted to the base and configured to house at least one battery which is electrically coupled to the drive train.

5. The electric-powered submersible vacuum cleaner of claim 1, wherein the drive train includes an electric motor coupled to the impeller.

6. The electric-powered submersible vacuum cleaner of claim 5, wherein the electric motor is coupled to the impeller via a rotatable drive shaft.

7. The electric-powered submersible vacuum cleaner of claim 5, wherein the electric motor is coupled to the impeller via a transmission assembly.

8. The electric-powered submersible vacuum cleaner of claim 5 further comprising a drive train mount assembly having a plurality of spaced apart support members, each support member having a lower end coupled to and extending upwardly from the upper surface of the base and an upper end configured to mount to and position the drive train and impeller in a direction normal to the surface of the base.

9. The electric-powered submersible vacuum cleaner of claim 7, wherein the transmission assembly includes a torque limiter assembly configured to regulate rotation of the impeller.

10. The electric-powered submersible vacuum cleaner of claim 9, wherein the torque limiter assembly is a clutch assembly.

11. The electric-powered submersible vacuum cleaner of claim 9, wherein the torque limiter assembly includes an adjustable locking mechanism to manually set slippage.

12. The electric-powered submersible vacuum cleaner of claim 1 further comprising a plurality of rotationally-mounted supports extending from the lower surface of the base and configured to facilitate movement of the vacuum cleaner over the surface of the pool.

13. The electric-powered submersible vacuum cleaner of claim 1, wherein the plurality of rotatably-mounted supports are adjustable to raise or lower the vacuum cleaner with respect to the surface of the pool.

14. The electric-powered submersible vacuum cleaner of claim 1, further comprising at least one brush mounted to the lower surface of the base and extending towards the surface of the pool.

15. The electric-powered submersible vacuum cleaner of claim 1, wherein the impeller is positioned at a predetermined height above the lower surface of the base.

16. The electric-powered submersible vacuum cleaner of claim 1, wherein the impeller includes a conically shaped cap extending towards the surface of the pool.

17. The electric-powered submersible vacuum cleaner of claim 1, wherein the outwardly extending flange is further configured to decrease drag and direct flow of the water from the discharge conduit.

18. The electric-powered submersible vacuum cleaner of claim 17, wherein the outwardly extending flange is curved.

19. The electric-powered submersible vacuum cleaner of claim 1, wherein the filter includes an opening configured to circumscribe the discharge conduit beneath the outwardly extending flange.

20. The electric-powered submersible vacuum cleaner of claim 1, wherein the discharge conduit includes at least one reinforcement member extending between the upper surface of the base and the outwardly extending flange.

21. The electric-powered submersible vacuum cleaner of claim 1, wherein the handle is rotatably attached to the base.

22. The electric-powered submersible vacuum cleaner of claim 21, wherein the handle is lockable in a fixed position relative to the base.

23. The electric-powered submersible vacuum cleaner of claim 22, wherein the lockable handle is configured to remain in a locked state when the cleaner is inverted such that the inlet port is orientated upwards towards and draws debris proximate the surface of the water in the pool.

24. The electric-powered submersible vacuum cleaner of claim 1, wherein the handle includes a locking mechanism configured to remain in a locked state including when the cleaner is inverted such that the inlet port is orientated upwards towards and draws debris proximate the surface of the water in the pool.

25. The electric-powered submersible vacuum cleaner of claim 1, wherein at least a portion of the drive train is positioned coaxially above the discharge conduit.

26. A submersible electrically powered vacuum cleaner for filtering water in a pool comprising:

a submersible housing having a base and a discharge conduit, the base including an upper surface and a lower surface, the lower surface being positionable over a surface of the pool, and an opening extending through the upper and lower surfaces to define an inlet port;

a plurality of rotationally-mounted supports extending from the lower surface of the base and configured to facilitate movement of the vacuum cleaner over a surface of the pool;

an impeller for drawing said water and debris from the surface of the pool;

an electric-powered drive train directly coupled to the housing and configured to rotate the impeller;

the discharge conduit positioned above and in fluid communication with the inlet port and extending substantially normal with respect to the upper surface of the base, said discharge conduit circumscribing a first portion of the impeller to direct the flow of water and debris drawn through the inlet port by the impeller, and the discharge conduit having an outwardly extending flange circumscribing a second portion of the impeller, wherein the impeller includes one or more blades having a leading edge and a trailing edge, the impeller being set at a height such that the leading edges of the one or more impeller blades are positioned to extend into the discharge conduit below a lower portion of the outwardly extending flange and the trailing edges of the one or more impeller blades extend above the lower portion of the outwardly extending flange;

a filter mounted to the housing over an outlet of the discharge conduit and configured to filter the debris from the drawn water and pass filtered water into the pool; and a handle configured to attach to and facilitate manual movement of the vacuum cleaner over the surface of the pool.

27. The electric-powered submersible vacuum cleaner of claim 26, wherein at least a portion of the drive train is positioned coaxially above the discharge conduit.

* * * * *